United States Patent [19]

Nett

[11] 4,168,694

[45] Sep. 25, 1979

[54] CARBURETOR COVER KIT

[76] Inventor: James A. Nett, c/o H20 Well Service, Grainfield, Kans. 67737

[21] Appl. No.: 875,321

[22] Filed: Feb. 6, 1978

[51] Int. Cl.[2] ..... F02B 77/00

[52] U.S. Cl. ..... 123/198 R; 150/52 K; 55/DIG. 28; 261/1

[58] Field of Search ..... 123/198 R, 198 E, 195 C, 123/142; 150/52 R, 52 K; 220/325, 327; 134/30, 37; 55/DIG. 28; 261/1

[56] References Cited

U.S. PATENT DOCUMENTS

| | | | |
|---|---|---|---|
| 1,584,505 | 5/1926 | Bevins | 123/98 R |
| 2,493,120 | 1/1950 | Eaton | 134/30 |
| 3,181,523 | 5/1965 | Casey | 123/198 R |
| 3,269,710 | 8/1966 | Ramus | 150/52 K |
| 3,344,944 | 10/1967 | Shutt et al. | 220/325 |
| 3,566,586 | 3/1971 | Langness | 55/DIG. 28 |
| 3,791,112 | 2/1974 | Lidstone | 55/DIG. 28 |

*Primary Examiner*—Ira S. Lazarus

[57] ABSTRACT

A carburetor kit for placing over the top of a vehicle's carburetor when the vehicle's air filter assembly has been removed. The kit is used to prevent liquid from entering into the carburetor when the vehicle's engine is cleaned using a high pressure spray.

6 Claims, 2 Drawing Figures

CARBURETOR COVER KIT

BACKGROUND OF THE INVENTION

This invention relates generally to a carburetor cover and more particularly, but not by way of limitation, to a carburetor cover kit used for protecting a carburetor when the air filter assembly of a vehicle is removed and the top of the vehicle's engine is cleaned using a high pressure liquid spray.

Heretofore there have been various types of carburetor covers used for protecting a new carburetor during the storing and shipping of individual carburetors. Also, there are prior art protective covers and hoods for various types of carburetors and ignition systems.

With the advent of neighborhood commercial car washes, a vehicle owner may now wash his own vehicle using a portable hand-held nozzle ejecting a high pressure liquid spray of hot water and soap. Also, many vehicle owners use the liquid spray to clean off motor oil and dirt on top of the engine. To do this the vehicle's air cleaner assembly is often removed so that the area around the carburetor may be cleaned. When the air cleaner assembly is removed, water is often inadvertently sprayed into the carburetor making the engine difficult to start. The present invention eliminates this problem.

None of the prior art carburetor hoods or covers provide the specific advantages and structure of the subject invention for protecting a carburetor when cleaning a vehicle engine with a high pressure liquid spray.

SUMMARY OF THE INVENTION

The subject invention prevents liquid from entering the top of a carburetor when the air filter assembly has been removed from the top of the engine.

The subject carburetor cover kit is simple in design, inexpensive, easy-to-install and remove, and is readily adaptable for various sizes and makes of carburetors used on different types of vehicles having an internal combustion engine.

The kit also provides protection from the liquid spray entering a standard crankcase ventilation tube and vacuum line fittings which are detached from the air filter assembly when the air filter assembly is removed from the top of the carburetor when cleaning the vehicle engine.

The carburetor cover kit includes a carburetor cap having a flat horizontal annular-shaped top with an aperture through the center thereof for receiving an air filter bolt therethrough. The cap further includes downwardly extending sides which are received around the top of the carburetor and thereon. A spacer cap is received on top of the carburetor cap and includes an annular-shaped top with an aperture therethrough for receiving the air filter bolt therethrough. The spacer cap includes downwardly extending sides which are secured to the top of the carburetor cap. A wing nut which is not part of the kit is used for securing the air filter assembly to the top of the carburetor is used for securing the spacer cap on top of the carburetor cap and securing the kit to the top of the carburetor. The kit further includes a crankcase ventilation tube plug and vacuum line caps to prevent the high pressure liquid spray from entering the tubes and fittings when they are removed from the air filter assembly.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
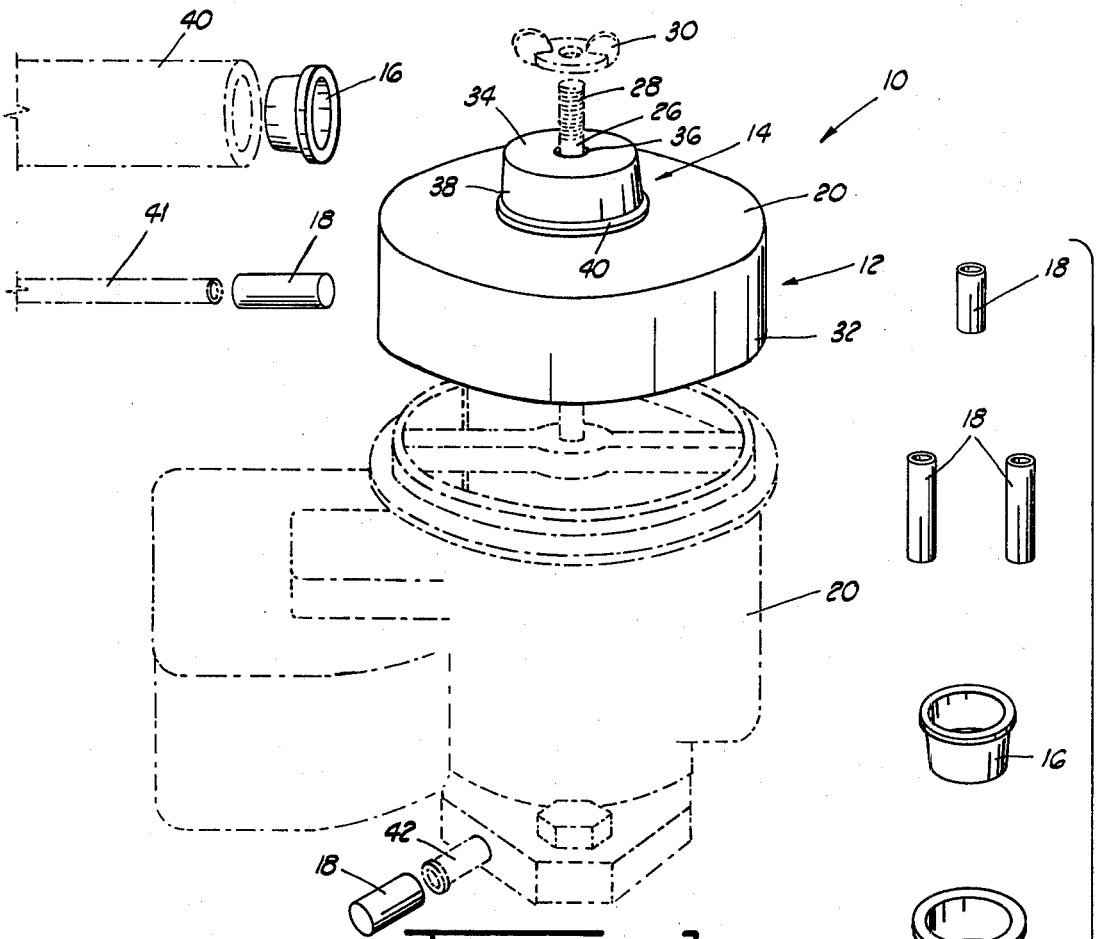
FIG. 1 illustrates a perspective view of the carburetor kit disposed above a standard carburetor shown in dotted lines.
Figure 2:
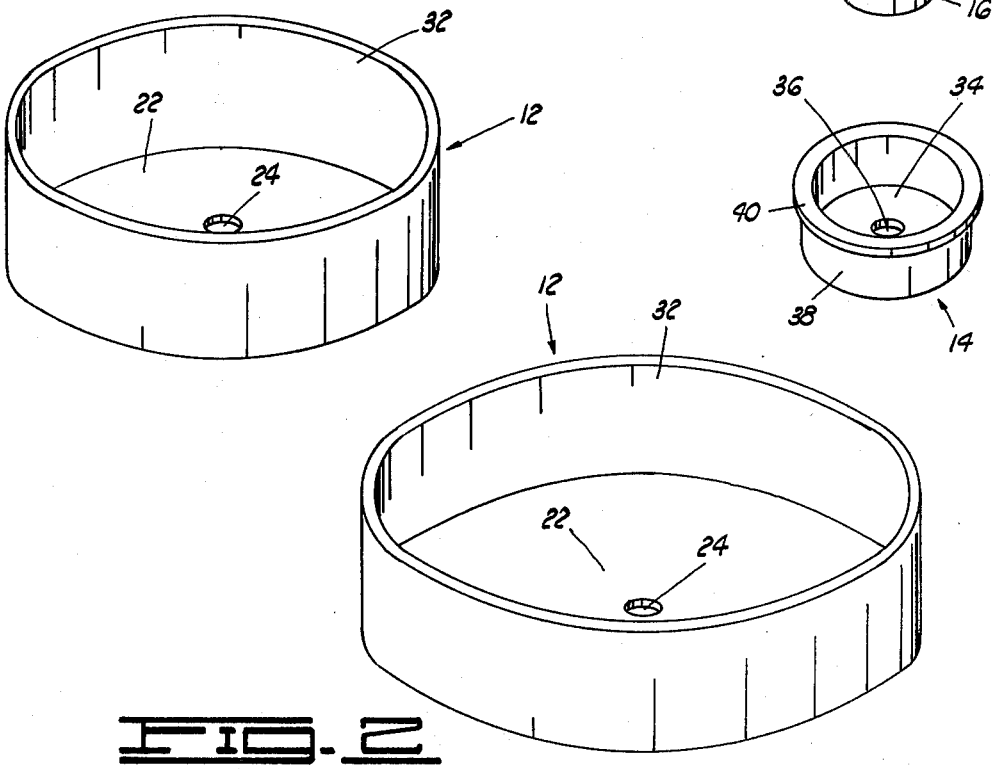
FIG. 2 illustrates a perspective view of the individual elements of the carburetor kit.

In FIG. 1, the carburetor cover kit is designated by general reference numeral 10. The kit 10 includes a carburetor cap 12, a spacer cap 14, a crankcase ventilation tube plug 16, and a heat exchanger vacuum line cap 18. The carburetor cap 12 can be seen disposed above a standard carburetor 20 shown in dotted lines. The carburetor cap 12 includes a flat horizontal annular-shaped top 22 having an aperture 24 through the center thereof. The aperture 24 is seen in FIG. 2. The aperture 24 is used for receiving an upwardly extending air filter bolt 26 having a threaded end portion 28 which is used for receiving a wing nut 30. The bolt 26 is used for securing an air filter assembly to the top of the carburetor 20. The air filter assembly is not shown in the drawings and has been removed for the installation of the kit 10. The carburetor cap 12 further includes downwardly extending sides 32 which are received around the carburetor 20 and on top thereof.

The spacer 14 includes a flat horizontal annular-shaped top 34 with an aperture 36 through the center thereof for receiving the air filter bolt 26. The spacer 14 further includes downwardly extending sides 38 with a flange portion 40 therearound and integrally formed in the edges of the sides 28. The spacer 14 serves two purposes. The first purpose is it provides space for securing the carburetor cap to the top of the carburetor 20 when using the threaded portion 28 at the top of the bolt 26. The second and most important purpose of the spacer 14 is should any high pressure liquid spray pass through the aperture 36 or underneath the flange portion 40 of the spacer cap 14, this liquid will be trapped inside the spacer and prevented from entering into the carburetor. By trapping the liquid, potential starting problems of the vehicle's engine are eliminated, which could happen if the carburetor cap 12 was used alone without the spacer cap 14.

A portion of a crankcase ventilation tube 40 and a vacuum line tube 41 are shown in FIG. 1. The tubes 40 and 41 are standard equipment on late model vehicles. The crank ventilation tube 40 is used for ventilating fumes from the crankcase to the air filter assembly. The vacuum line tube 41 circulates hot air from the carburetor to a heat exchanger in an air breather which is part of the air filter assembly. The hot air helps the engine during cold weather.

When the air filter assembly is removed, the ends of the crankcase ventilation tube 40 and vacuum line tube 41 are left exposed to the high pressure liquid spray. Therefore, the kit 10 further provides plugs 16 and 18 having various dimensions for inserting in the ends of the tubes 40 and 41 and over a fitting 42 to prevent the liquid spray from entering the tubes and the carburetor 20.

In FIG. 2, the carburetor cap 12 is shown having two different diameters of the top 22. The diameter of the top 22 of the carburetor cap 12 will vary for various sizes and makes of the vehicle. The length of the sides 32 of the cap 12 will vary with the various changes in diameter of the top 22 since it is desired to keep a low profile carburetor cap 12 for ease in packaging of the kit 10. The carburetor cap 12 and the spacer cap 14 are shown upside down and it can be appreciated that the caps 12 and 14 would be turned over when placing on top of the carburetor 20. Also shown in FIG. 2 is the crankcase ventilation tube plug 16 having different diameters for receiving in different sizes of crankcase ventilation tubes 40. Also shown are various sizes of vacuum line tube caps 18 for inserting over various sizes of vacuum line fittings 42. Also the kit 10 will include additional plugs 1 and 18 should they become lost when the kit 10 is used for cleaning the vehicle's engine or more than one vacuum line tube goes to air filter assembly.

Changes may be made in the construction and arrangement of the parts or elements of the embodiment as disclosed herein without departing from the spirit or scope of the invention as defined in the following claims.

I claim:

1. A carburetor kit for placing over the top of a vehicle's carburetor and securing it to the air filter bolt when the vehicle's air filter assembly has been removed, the kit used when cleaning the vehicle's engine with a high pressure liquid spray, the kit comprising:

a carburetor cap, said cap having a flat horizontal annular-shaped top with an aperture through the center thereof for receiving the air filter bolt therethrough, said cap further including downwardly extending sides, the sides received around and on top of the carburetor; and a spacer cap, said spacer cap having a flat horizontal annular-shaped top with an aperture through the center thereof for receiving the air filter bolt therethrough and downwardly extending sides, the sides received on top of the top of said carburetor cap;

a wing nut used for securing the air filter assembly to the air filter bolt threaded on the air filter bolt downwardly on top of said spacer cap securing said spacer cap and said carburetor cap to the top of the carburetor.

2. The kit as described in claim 1 wherein said spacer cap includes an annular-shaped flange integrally formed around the edge of the downwardly extending sides.

3. The kit as described in claim 1 further including a crankcase ventilator tube plug for fitting in the end of the crankcase ventilator tube when the tube is removed from the air filter assembly when cleaning the top of the vehicle's engine.

4. The kit as described in claim 1 further including vacuum line caps for fitting in the end of the vacuum line fitting when vacuum line or lines are removed from the air filter assembly when cleaning the top of the vehicle's engine.

5. The kit as described in claim 1 wherein the top of said carburetor cap is dimensioned for various size carburetors so that the sides of said carburetor cap may be received around and on top of the carburetor.

6. A carburetor kit for placing over the top of a vehicle's carburetor and securing it to the air filter bolt when the vehicle's air filter assembly has been removed, the kit used when cleaning the vehicle's engine with a high pressure liquid spray, the kit comprising:

a carburetor cap, the cap having a flat horizontal annular-shaped top with an aperture through the center thereof for receiving the air filter bolt therethrough, said cap further including downwardly extending sides, the sides received around and on top of the carburetor;

a spacer cap, said spacer cap having a flat horizontal annular-shaped top with an aperture through the center thereof for receiving the air filter bolt therethrough and downwardly extending sides, the edge of the sides having an annular-shaped flange therearound, the flange received on top of said carburetor cap;

a crankcase ventilation tube plug for inserting in the end of the crankcase ventilation tube when the tube is removed from the air filter assembly; and vacuum line caps for inserting in the end of vacuum line fitting tubes or carburetor fitting when vacuum lines are removed from the air filter assembly.

* * * * *